US012082605B2

(12) United States Patent
Bruner et al.

(10) Patent No.: US 12,082,605 B2
(45) Date of Patent: Sep. 10, 2024

(54) GRINDER AND PACKER APPARATUS

(71) Applicant: Z Cannabis, LLC, Wichita, KS (US)

(72) Inventors: Steven L. Bruner, Wichita, KS (US); Christien W. Degrandmont, Wichita, KS (US)

(73) Assignee: Z Cannabis, LLC, Wichita, KS (US)

( * ) Notice: Subject to any disclaimer, the term of this patent is extended or adjusted under 35 U.S.C. 154(b) by 313 days.

(21) Appl. No.: 17/673,863

(22) Filed: Feb. 17, 2022

(65) Prior Publication Data

US 2023/0255258 A1 Aug. 17, 2023

(51) Int. Cl.

| | |
|---|---|
| ***A24C 5/39*** | (2006.01) |
| ***A24B 7/06*** | (2006.01) |
| ***A24C 5/42*** | (2006.01) |

(52) U.S. Cl.

CPC ..... *A24C 5/395* (2013.01); *A24B 7/06* (2013.01); *A24C 5/42* (2013.01)

(58) Field of Classification Search

CPC .. A24C 5/395; A24C 5/42; A24B 7/06; A24F 17/00; A47J 42/40; A47J 42/50

See application file for complete search history.

(56) References Cited

U.S. PATENT DOCUMENTS

| | | | |
|---|---|---|---|
| 4,304,363 | A | 12/1981 | Atkielski |
| 8,083,167 | B1 | 12/2011 | Namakian et al. |
| 9,427,020 | B2 | 8/2016 | Ruzycky |
| 9,814,259 | B1 | 11/2017 | Richmond et al. |
| 10,455,984 | B1 | 10/2019 | Abehasera |
| 11,019,962 | B2 | 6/2021 | Kick |
| 11,178,905 | B2 | 11/2021 | Karim |
| 2018/0344086 | A1* | 12/2018 | Mcdonough Migale ..... A47J 42/24 |
| 2020/0187717 | A1* | 6/2020 | Pagan ..... A47J 42/34 |
| 2021/0015146 | A1 | 1/2021 | Chaben et al. |
| 2021/0100277 | A1* | 4/2021 | Spielman ..... B02C 18/08 |
| 2021/0219598 | A1 | 7/2021 | Ruzycky |

OTHER PUBLICATIONS

Grindarolla Cone Loader, Grinder, and Stash System; Amazon webpage: https://www.amazon.com/Grindarolla-Loader-Grinder-Convenient-Durable/dp/B081FJV5JZ.

Free Boy Transparent Grinder, Amazon webpage: https://www.amazon.com/Free-Boy-Transparent-Grinder-Loader/dp/B098DHJ4B8/.

HIGHROLLER Transparent Herb & Spice Grinder; Amazon webpage: https://www.amazon.com/HIGHROLLER-Transparent-Spice-Grinder-Grind/dp/B084Z69B17.

* cited by examiner

*Primary Examiner* — Mohammed S. Alawadi

(74) *Attorney, Agent, or Firm* — Hovey Williams LLP

(57) ABSTRACT

An apparatus for preparing organic material and loading the organic material into a cone comprises a cylindrical body, a grinder assembly, a cone holder, and a funnel. The cylindrical body includes top and bottom openings. The grinder assembly is removably attached to the top opening of the cylindrical body and is configured to grind the organic material. The grinder assembly includes a hole for the ground organic material to pass through. The cone holder extends into the bottom opening of the main cylindrical body and is releasably secured thereto. The cone holder includes an aperture for receiving the cone. The funnel comprises a wide portion for receiving the ground material that passes through the hole of the grinder assembly and a narrow portion that extends into an end opening of the cone when the cone is held by the cone holder in the cylindrical body.

16 Claims, 7 Drawing Sheets

GRINDER AND PACKER APPARATUS

BACKGROUND

Grinders are used to grind organic material into smaller pieces for loading into a device for consumption, such as a combustible cone. Cones are often funnel shaped with a wide top opening and a narrower bottom opening. Filter materials can be placed toward the bottom opening of the cones. Ground material from grinders are often hand loaded into the top opening of the cone. However, it is tedious and messy to transfer ground material from grinders.

The background discussion is intended to provide information related to the present invention which is not necessarily prior art.

SUMMARY OF THE INVENTION

The present invention solves the above-described problems and other problems by providing methods of forming apparatuses and apparatuses that enable quick, efficient, and compact loading of ground organic material into a cone.

An apparatus constructed according to an embodiment of the present invention is provided for preparing organic material and loading the organic material into a cone with an end opening. The apparatus comprises a cylindrical body, a grinder assembly, a cone holder, and a funnel. The cylindrical body includes top and bottom openings. The grinder assembly is removably attached to the top opening of the cylindrical body and is configured to grind the organic material. The grinder assembly includes a hole for the ground organic material to pass through. The cone holder extends into the bottom opening of the main cylindrical body and is releasably secured thereto. The cone holder includes an aperture for receiving the cone.

The funnel comprises a wide portion for receiving the ground material that passes through the hole of the grinder assembly and a narrow portion that extends into an end opening of the cone when the cone is held by the cone holder in the cylindrical body. Because the narrow portion of the funnel extends into the end opening of the cone, the ground material falls and is guided right into the cone without losing ground material around the cone within the cylindrical body. Further, because the grinder assembly is removably attached to the top opening of the cylindrical body, the cone can be packed between grinding steps. The inventors have found that due to the sticky nature of certain organic matter, packing a cone once it is completely loaded is difficult as the ground material often remains stuck to the walls. Thus, packing stuck ground material can cause rips in the cone and/or cause the cone to collapse.

A method of forming an apparatus according to an embodiment of the present invention broadly comprises forming a first plurality of engagement threads circumferentially spaced on an upper end of a cylindrical body via computer numerical control (CNC) milling; forming a second plurality of engagement threads circumferentially spaced on a lower end of a grinder assembly via CNC milling; inserting a cone holder into a bottom opening of the cylindrical body; inserting a funnel into a top opening of the main cylindrical body so that a narrow portion of the funnel extends into an end opening of a cone when the cone is held by the cone holder within the cylindrical body; inserting the upper end of the cylindrical body into the lower end of the grinder assembly; and rotating the cylindrical body relative to the grinder assembly so that the first plurality of engagement threads engage the second plurality of engagement threads, thereby releasably securing the grinder assembly to the cylindrical body.

By having a funnel that extends into the end opening of the cone, the ground material is directed into the cone without losing ground material around the cone within the cylindrical body. Further, the engagement threads allow the grinder assembly to be quickly removed and reattached to the cylindrical body so that the cone can be quickly and efficiently packed between grinding. This allows a first layer of the ground material to be quickly packed, which the inventors have found to be essential to reducing heat near the filter. Additionally, by using CNC milling to form the threads, precise formation of the threads is achieved, which avoids jams and allows for consistent reattachment of the grinder assembly.

An apparatus constructed according to another embodiment of the present invention broadly comprises a main cylindrical body, a grinder assembly, a cone holder, and a funnel. The main cylindrical body includes a bottom opening, an upper end defining a top opening, and a first plurality of engagement threads circumferentially spaced on the upper end.

The grinder assembly is removably attached to the top opening of the cylindrical body and is configured to grind the organic material. The grinder assembly includes a grinder cylindrical body, an upper body, a top blade, and a bottom blade. The grinder cylindrical body has a top opening, a lower end defining a bottom opening for receiving the upper end of the main cylindrical body, and a second plurality of engagement threads circumferentially spaced on the lower end for releasably engaging the first plurality of engagement threads. The upper body releasably mates with the grinder cylindrical body. The top blade is secured to the upper body. The bottom blade is secured to the grinder cylindrical body and includes a hole for allowing the ground organic material to pass therethrough.

The cone holder extends into the bottom opening of the main cylindrical body and is releasably secured thereto. The cone holder includes an aperture for receiving the cone. The funnel extends into the top opening of the main cylindrical body and comprises a flange, a wide portion, and a narrow portion. The flange sits on the upper end of the main cylindrical body so that the flange is secured between the grinder assembly and the main cylindrical body. The wide portion opens to the bottom blade of the grinder assembly and is for receiving the ground organic material therefrom. The narrow portion extends into the end opening of the cone when the cone is held by the cone holder.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
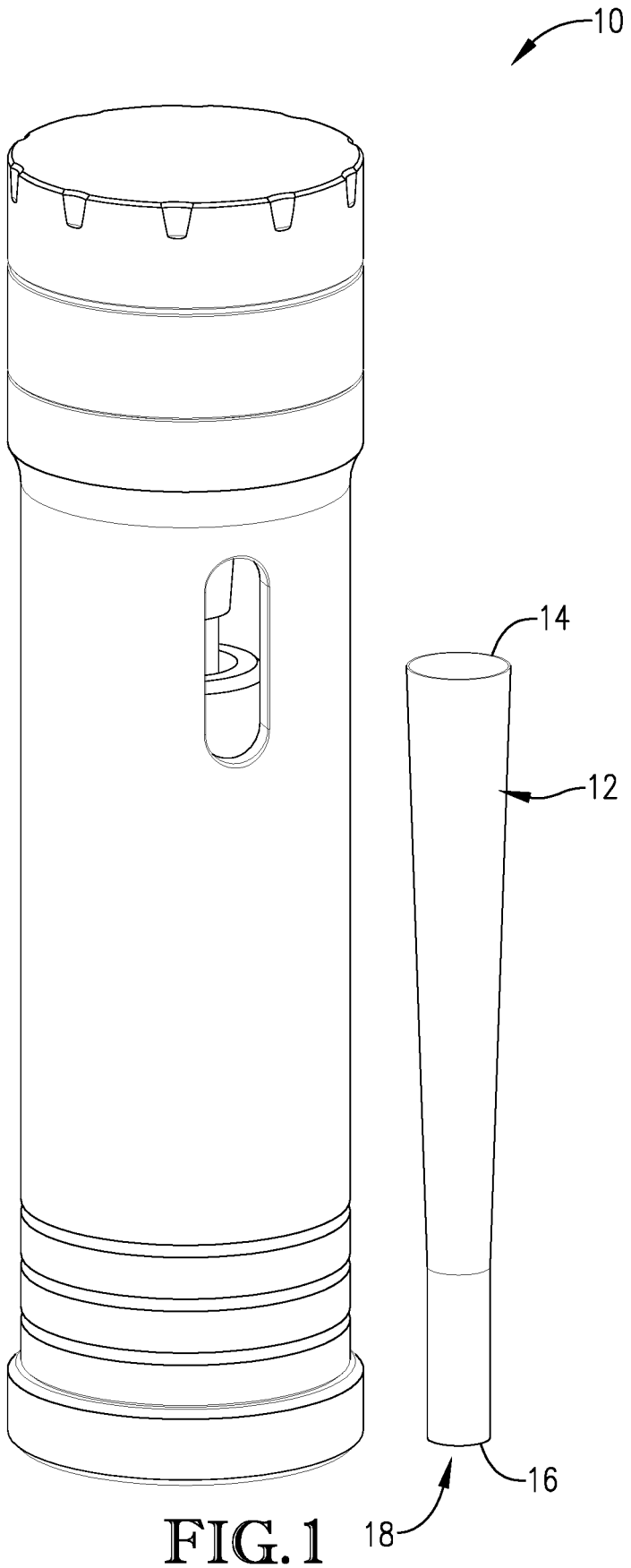
FIG. 1 is a front perspective view of an apparatus for grinding and loading organic material constructed in accordance with embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
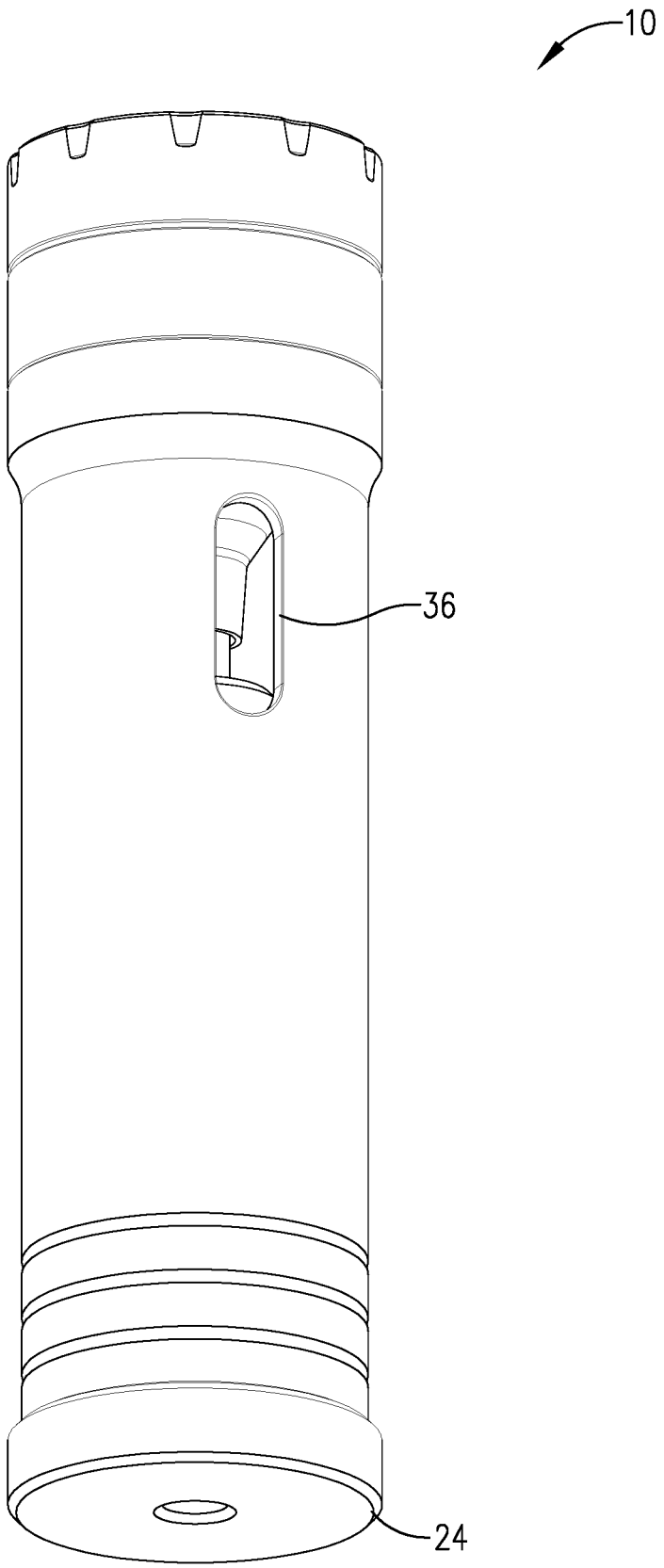
FIG. 2 is a rear perspective view of the apparatus of FIG. 1.

Turning to FIGS. 1 and 2, an apparatus 10 constructed in accordance with an embodiment of the invention is illustrated. The illustrated apparatus 10 is a grinder and loader device for preparing organic material and loading it into a cone 12. The organic material may be tobacco, marijuana, or other matter for consumption via the cone 12. The cone 12 may be funnel shaped and include an upper wide opening 14 and a lower narrow opening 16. The cone 12 may also include filter material, such as a filter 18, positioned proximate to the narrow opening 16.

Figure 3:
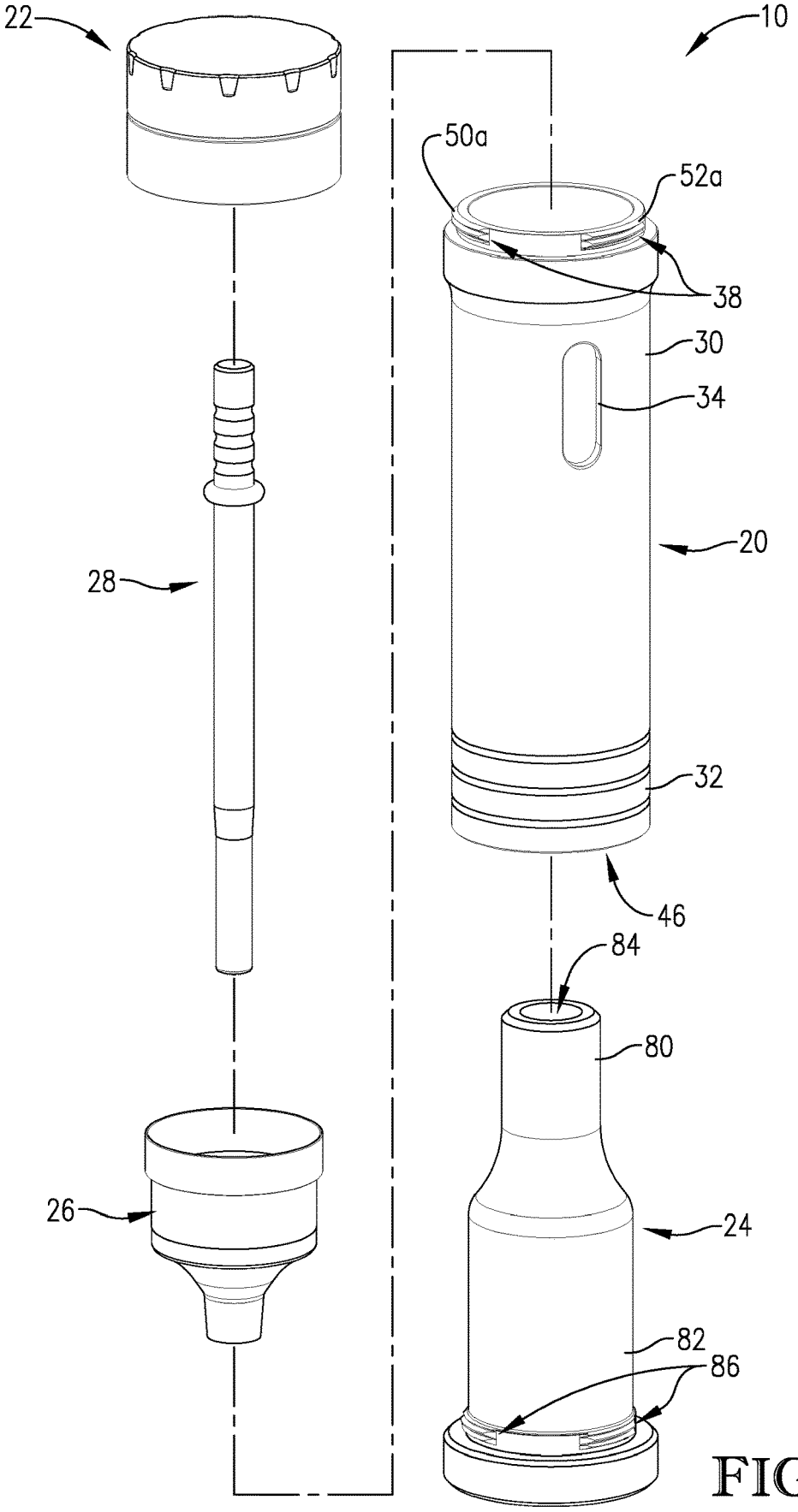
FIG. 3 is an exploded view of the apparatus of FIG. 1.
Figure 4:
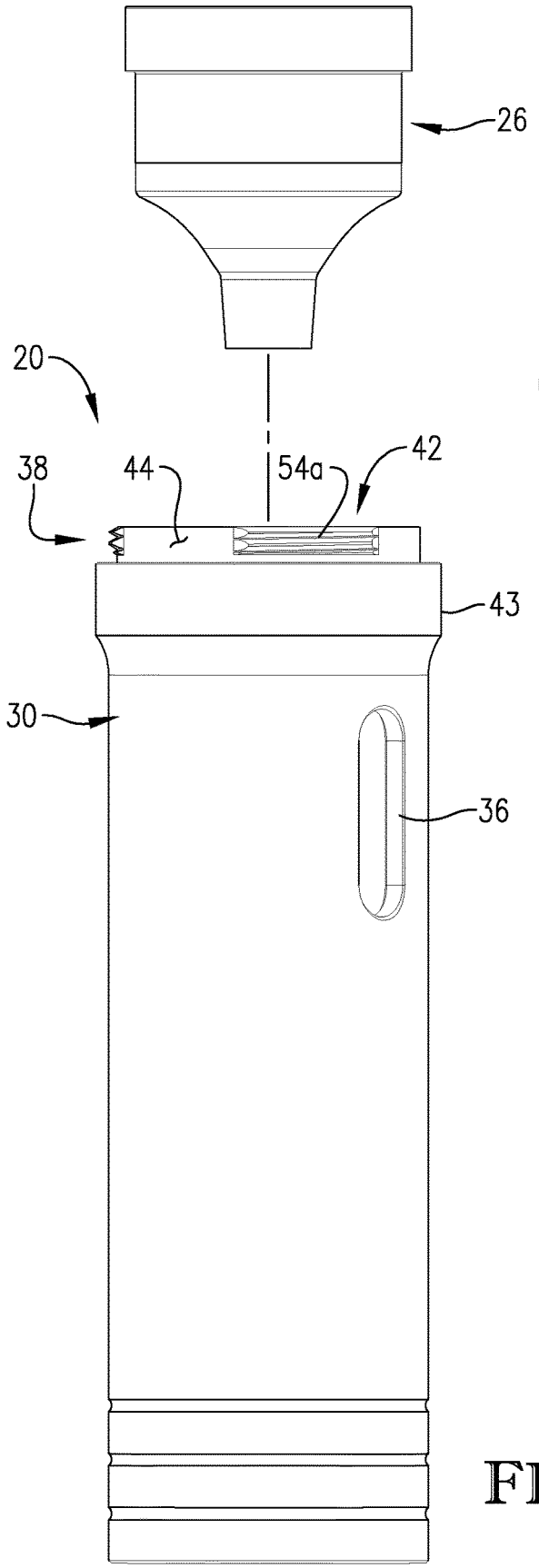
FIG. 4 is a perspective view of a cylindrical body of the apparatus of FIG. 1.
Figure 5:
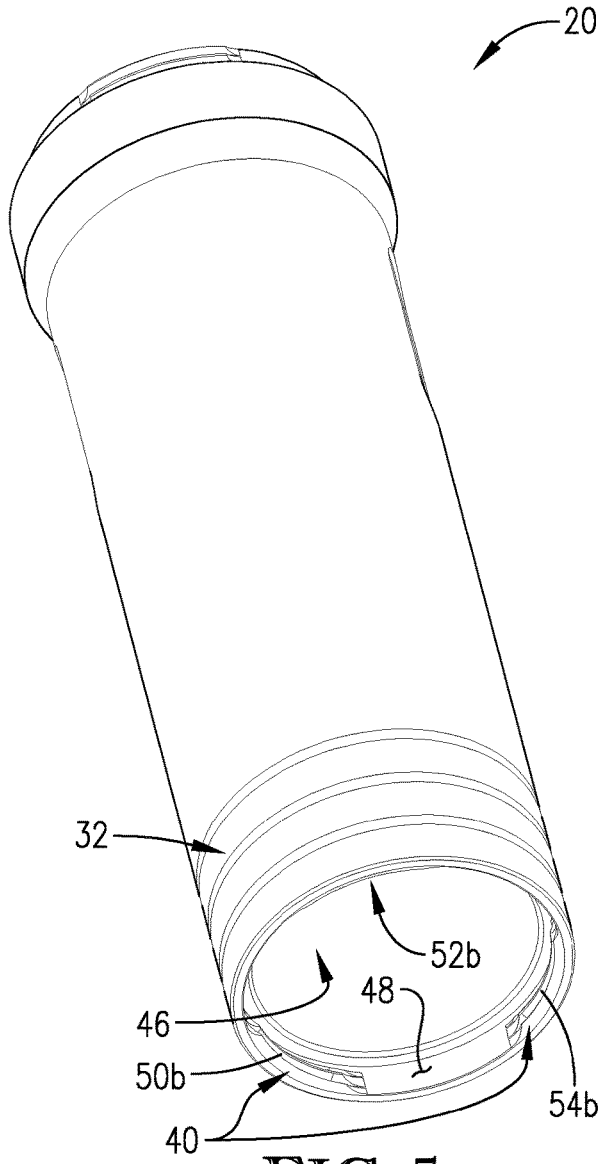
FIG. 5 is a perspective view of a bottom end of the cylindrical body of FIG. 4.

Turning to FIG. 3, the apparatus 10 comprises a cylindrical body 20, a grinder assembly 22, a cone holder 24, a funnel 26, and a packer rod 28. The cylindrical body 20 comprises an upper end 30, a lower end 32, one or more windows 34, 36 for viewing the cone 12 within the cylindrical body 20 (the rear window 36 is depicted in FIG. 2), a plurality of engagement threads 38 on the upper end 30, and a plurality of engagement threads 40 on the lower end 32 (as depicted in FIG. 5). Turning to FIG. 4, the upper end 30 defines a top opening 42, and the plurality of engagement threads 38 may be circumferentially spaced on an outer surface 44 of the upper end 30. The upper end 30 may also include a collar 43 below the engagement threads 38 on which the grinder assembly 22 may sit. Turning to FIG. 5, the lower end 32 defines a bottom opening 46, and the plurality of engagement threads 40 may be circumferentially spaced on an inner surface 48 of the lower end 32. As depicted in FIGS. 2 and 3, the windows 34, 36 may be positioned proximate to the upper end 30 and opposing one another on the cylindrical body 20. The windows 34, 36 enable a user to look into the cylindrical body 20 to see the fill level of the cone 12.

As depicted in FIGS. 3-5, the plurality of engagement threads 38, 40 may comprise three sets of engagement threads 50*a,b*, 52*a,b*, 54*a,b* evenly spaced circumferentially on their respective ends 30, 32. While three sets are depicted, the cylindrical body 20 may have any number of sets of engagement threads without departing from the scope of the present invention. For example, there may be only one or two sets. Each set of engagement threads 50*a,b*, 52*a,b*, 54*a,b* may comprise three threads protruding from their respective end 30, 32 of the cylindrical body 20 and circumferentially extend in parallel on the respective end 30, 32 of the cylindrical body 20.

The cylindrical body 20 may be made of aluminum, aluminum alloy, or the like. The cylindrical body 20 and the engagement threads 38, 40 formed thereon may be formed using CNC milling so that the dimensions of the engagement threads 38, 40 are consistent and uniform, thereby preventing jams when attaching and removing the grinder assembly 22 and/or the cone holder 24.

Figure 7:
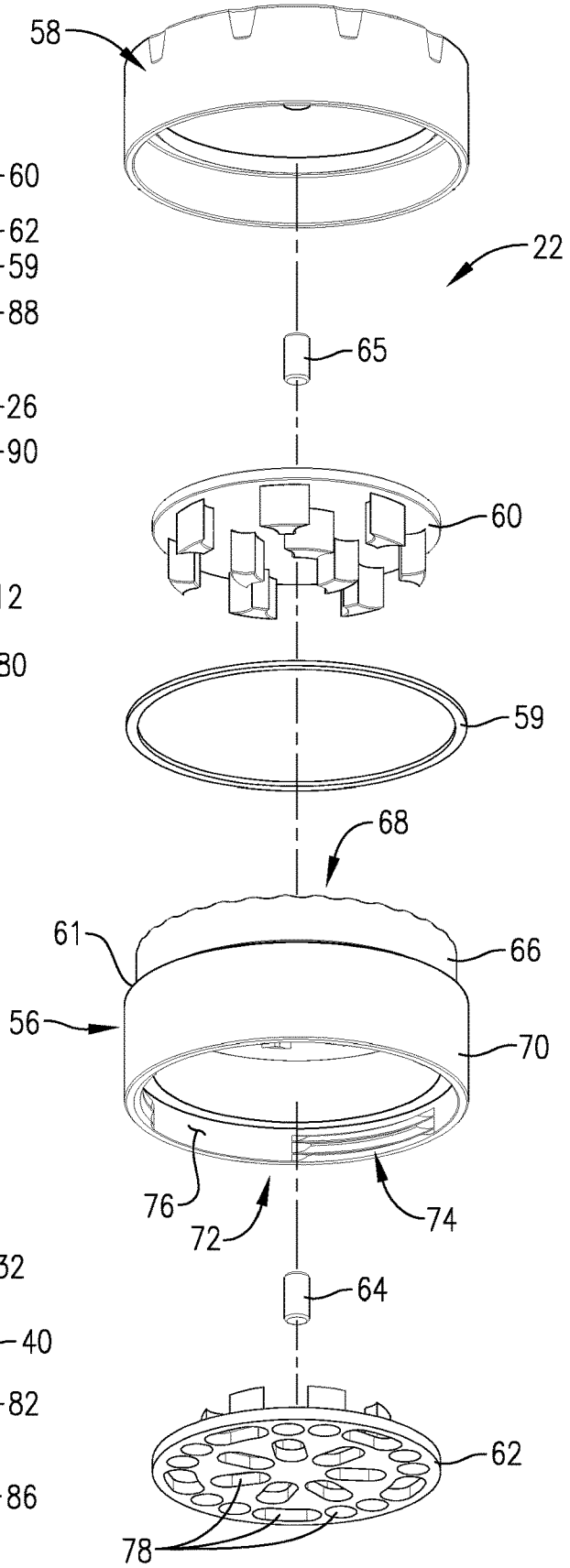
FIG. 7 is an exploded view of a grinder assembly of the apparatus of FIG. 1.

Turning to FIG. 7, the grinder assembly 22 is removably attached to the upper end 30 of the cylindrical body 20 and configured to grind the organic material. The grinder assembly 22 comprises a grinder cylindrical body 56, an upper body 58, a top blade 60, a bottom blade 62, and a pair of magnetic pins 64, 65. The grinder cylindrical body 56 includes an upper end 66 defining a top opening 68, a lower end 70 defining a bottom opening 72 for receiving the upper end 30 of the main cylindrical body 20, and a plurality of engagement threads 74 circumferentially spaced on the lower end 70 for releasably engaging the engagement threads 38 on the main cylindrical body 20. The engagement threads 74 on the grinder cylindrical body 56 may extend inwardly from an inner surface 76 and may be complementary to the engagement threads 38 on the main cylindrical body 20. The spacing of the engagement threads 38, 74 allow the grinder assembly 22 to quickly mate with the cylindrical body 20 by sliding the cylindrical body 20 into the opening 72 of the grinder assembly 22 and rotating them relative to one another so that their engagement threads 38, 74 interlock.

Figure 6:
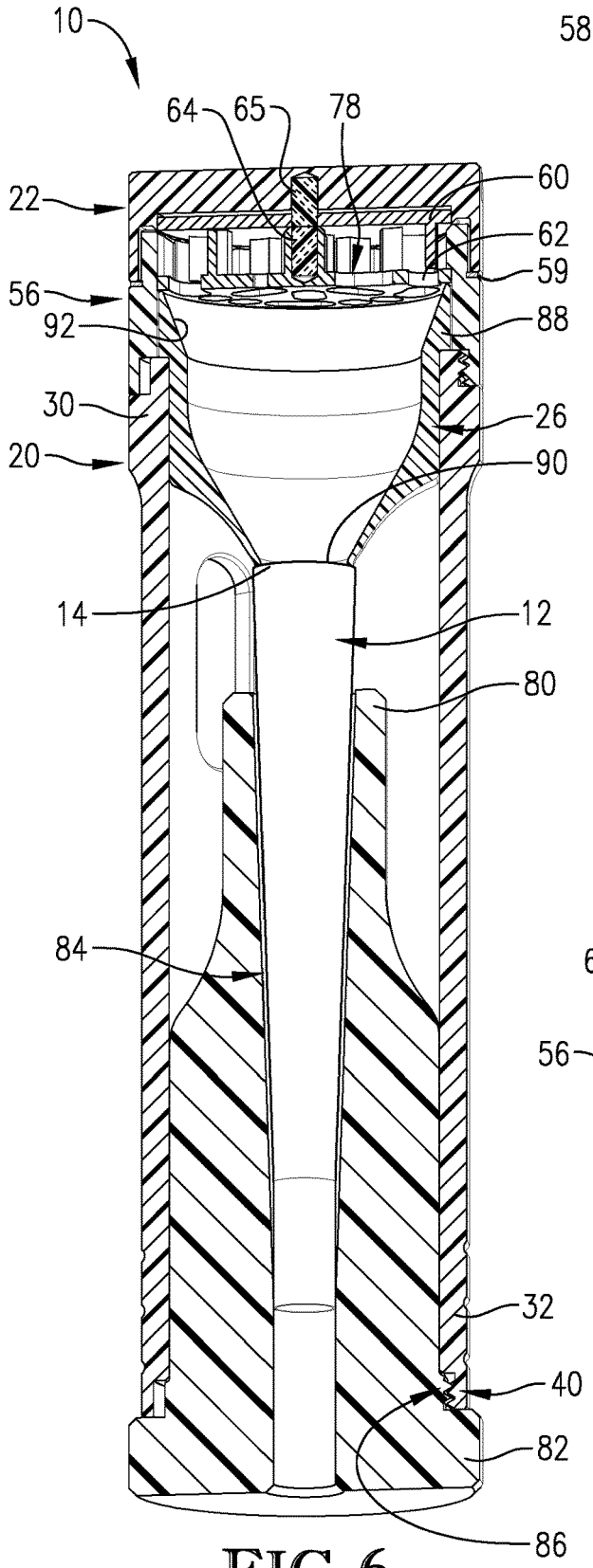
FIG. 6 is a sectional view of the apparatus of FIG. 1 with a cone positioned therein.

The upper body 58 releasably mates with the grinder cylindrical body 56. The top blade 60 may be secured to the upper body 58, and the bottom blade 62 may be secured to the grinder cylindrical body 56. The upper body 58 and the grinder cylindrical body 56 may be rotatable relative to one another so that the blades 60, 62 rotate relative to one another to grind the organic material. In some embodiments, a washer 59 may be positioned between the upper body 58 and the grinder cylindrical body 56 and rest on a shoulder 61 of the grinder cylindrical body 56. The bottom blade 62 includes one or more holes 78 for allowing the ground organic material to pass therethrough. The bottom blade 62 may abut the funnel 26 when the funnel 26 is seated on the cylindrical body 20 and the grinder assembly 22 as attached to the cylindrical body 20, as depicted in FIG. 6.

The magnetic pin 64 may be secured to the bottom blade 62, and the magnetic pin 65 may be secured to the top blade 60. The magnetic pins 64, 65 may be oriented relative to one another so that their magnetic poles are attracted to magnetically hold the upper body 58 and the grinder cylindrical body 56 together.

The grinder cylindrical body 56 and the upper body 58 may be made of aluminum, aluminum alloy, or the like and formed via CNC milling. The engagement threads 74 may also be formed using CNC milling to enable consistency and uniformity, thereby preventing jams when attaching and removing the grinder assembly 22. The top blade 60 and bottom blade 62 may be made of FDA grade titanium, titanium alloy, or the like.

Turning back to FIG. 3, the cone holder 24 extends into the bottom opening 46 of the main cylindrical body 20 and is releasably secured thereto. The cone holder 24 includes a top end 80, a bottom end 82, an aperture 84 for receiving the cone 12, and a plurality of engagement threads 86. Turning to FIG. 6, the aperture 84 extends from the top end 80 to the bottom end 82 and may be funnel-shaped with a wide region proximal to the top end 80 and a narrow region distal to the top end 80, or close to the bottom end 82. The aperture 84 may have a diameter at the bottom end 82 that is smaller than a diameter of the cone 12 to prevent the cone 12 from being pushed through the aperture 84 as the cone 12 is being packed. The engagement threads 86 are configured to engage the engagement threads 40 of the lower end 32 of the cylindrical body 20. The engagement threads 40, 86 may be engaged similar to the engagement threads 38, 74 discussed above. Additionally, the cone holder 24 may also be made of aluminum, aluminum alloy, or the like and be formed via CNC milling. The engagement threads 86 may also be formed using CNC milling to provide consistency and uniformity.

As shown in FIG. 6, the funnel 26 is seated on the cylindrical body 20 and comprises a wide portion 88 for receiving the ground material that passes through the holes 78 of the bottom blade 62 of the grinder assembly 22 and a narrow portion 90 that extends into the upper opening 14 of the cone 12 when the cone 12 is held by the cone holder 24 in the cylindrical body 20. The funnel 26 may include a flange 92 that sits on the upper end 30 of the main cylindrical body 20 so that the flange 92 is secured between the grinder assembly 22 and the main cylindrical body 20. When seated in the cylindrical body 20, the funnel 26 may tightly mate with the cylindrical body 20 so that it is secured thereto. In some embodiments, the flange 92 abuts the bottom blade 62 of the grinder assembly 22, and the bottom blade 62 is fixed to the grinder cylindrical body 56 so that the bottom blade 62 does not rotate relative to the funnel 26 and only the top blade 60 and the upper body 58 of the grinder assembly 22 rotate relative to the funnel 26. In some embodiments, the diameter of the narrow portion 90 is equal to or greater than the diameter of the holes 78 of the bottom blade 62 yet less than the diameter of the upper wide opening 14 of the cone 12. In some embodiments, the funnel 26 may be made of aluminum, aluminum alloy, or the like.

Figure 8:
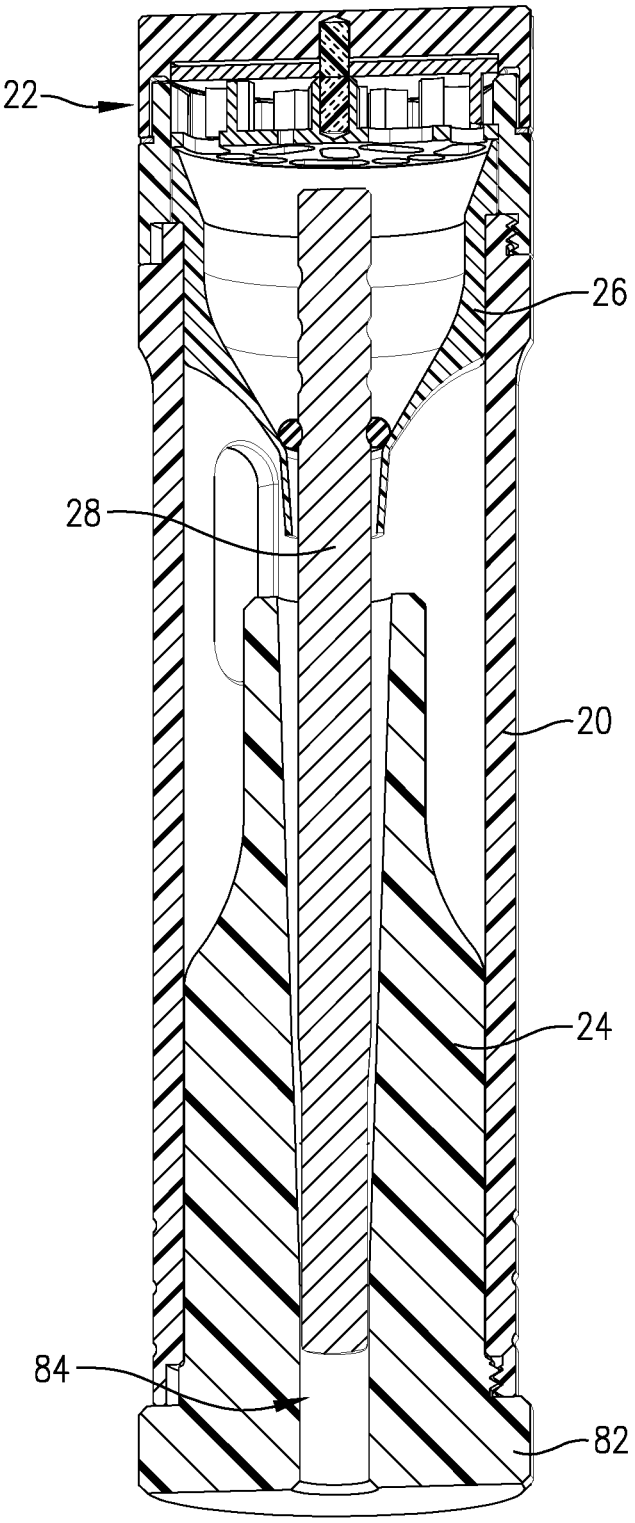
FIG. 8 is a sectional view of the apparatus of FIG. 1 with a packer rod positioned therein.

Turning to FIG. 8, the packer rod 28 is configured to be inserted through the funnel 26 when the grinder assembly is removed. The packer rod 28 may be inserted into the cone 12 when the cone 12 is held by the cone holder 24 in the cylindrical body 20 and used to pack the organic material into the cone 12. The packer rod 28 may also be inserted into the aperture 84 from the bottom end 82 of the cone holder 24 to push the cone 12 out of the cone holder 24. The packer rod 28 may have a length so that it can be stored in the cone holder 24 with the grinder assembly 22 enclosing the rod 28 within the cylindrical body 20.

In use, the cone holder 24 may be rotated relative to the cylindrical body 20 so that their engagement threads 40, 86 disengage. The cone holder 24 may then be pulled out of the bottom opening 46 of the cylindrical body 20 with the engagement threads 40, 86 passing by one another through circumferential spaces. The cone 12 may be placed in the aperture 84 through the top end 80 of the cone holder 24 with the filter 18 going in first so that it is positioned away from the top end 80. The cone holder 24 may be reattached to the cylindrical body 20 with the cone 12 held therein by inserting the cone holder 24 with the cone 12 into the bottom opening 46 of the cylindrical body 20 with the cone holder 24 oriented relative to the cylindrical body 20 so that the engagement threads 40, 86 can pass by one another. Once the flange on the bottom end 82 of the cone holder 24 abuts the bottom end 32 of the cylindrical body 20, the cone holder 24 may be rotated relative to the cylindrical body 20 so that their engagement threads 40, 86 engage one another, thereby securing the cone holder 24 to the cylindrical body 20 and the cone 12 within the cylindrical body 20.

The upper body 58 may be removed from the grinder cylindrical body 56 with the top blade 60 attached to the upper body 58. The organic material may be loaded into the grinder cylindrical body 56 and rest on the bottom blade 62 of the grinder assembly 22. The upper body 58 may be placed back on the grinder cylindrical body 56 and rotated relative to the cylindrical body 56 so that the blades 60, 62 grind, tear, cut, and/or shred the organic material so that portions of it fall through the holes 78 of the bottom blade 62 and into the funnel 26. Some of the ground organic material may fall through the narrow portion 90 of the funnel 26 and into the upper wide opening 14 of the cone 12.

The grinder assembly 22 may be removed by rotating the grinder cylindrical body 56 relative to the cylindrical body 20 so that their engagement threads 38, 74 disengage and pulling the cylindrical body 20 out of the lower end 70 of the grinder cylindrical body 56. The packer rod 28 may be inserted into the funnel 26 and used to push some of the ground organic material into the cone 12. The packer rod 28 may be inserted through the narrow portion 90 of the funnel 26 and used to pack the organic material compactly down against the filter 18 of the cone 12. The inventors have found that compacting the organic material proximate to the filter 18 of the cone 12 decreases the temperature of material next to the filter 18, which improves the consumption experience. By being able to efficiently remove the grinder assembly 22, a well packed cone 12 can be produced in a considerably shorter amount of time.

The grinder assembly 22 may be quickly reattached by pulling out the packer rod 28 and inserting the upper end 30 of the cylindrical body 20 into the lower end 70 of the grinder cylindrical body 56. The cylindrical body 20 and the grinder cylindrical body 56 may be rotated relative to one another so that their engagement threads 38, 74 engage one another, thereby resecuring the grinder assembly 22 to the cylindrical body 20. The organic material can continue to be grinded in the grinder assembly 22, and the grinder assembly 22 can be periodically removed for further packing. The inventors have discovered that due to the tacky oils present in some organic material, the organic material tends to stick to the walls of the cone 12. Thus, it is difficult to pack the cone 12 when it is full or has a certain amount of ground organic material that has not been packed yet. When the cone 12 is not packed frequently, attempts at packing the cone 12 to the desired amount of compactness often result in damage to the cone 12. Thus, the ability to frequently pack the cone 12 by quickly removing the grinder assembly 22, packing, and quickly reattaching the grinder assembly 22 to continue grinding enables efficient and easy loading of the cone 12 with more compact ground organic material.

When the cone 12 is filled, the cone holder 24 may be removed from the cylindrical body 20, and the packer rod 28 may be inserted into the aperture 84 of the cone holder 24 at the bottom end of the cone holder 24. The packer rod 28 may be used to push the loaded cone 12 out of the cone holder 24.

Figure 9:
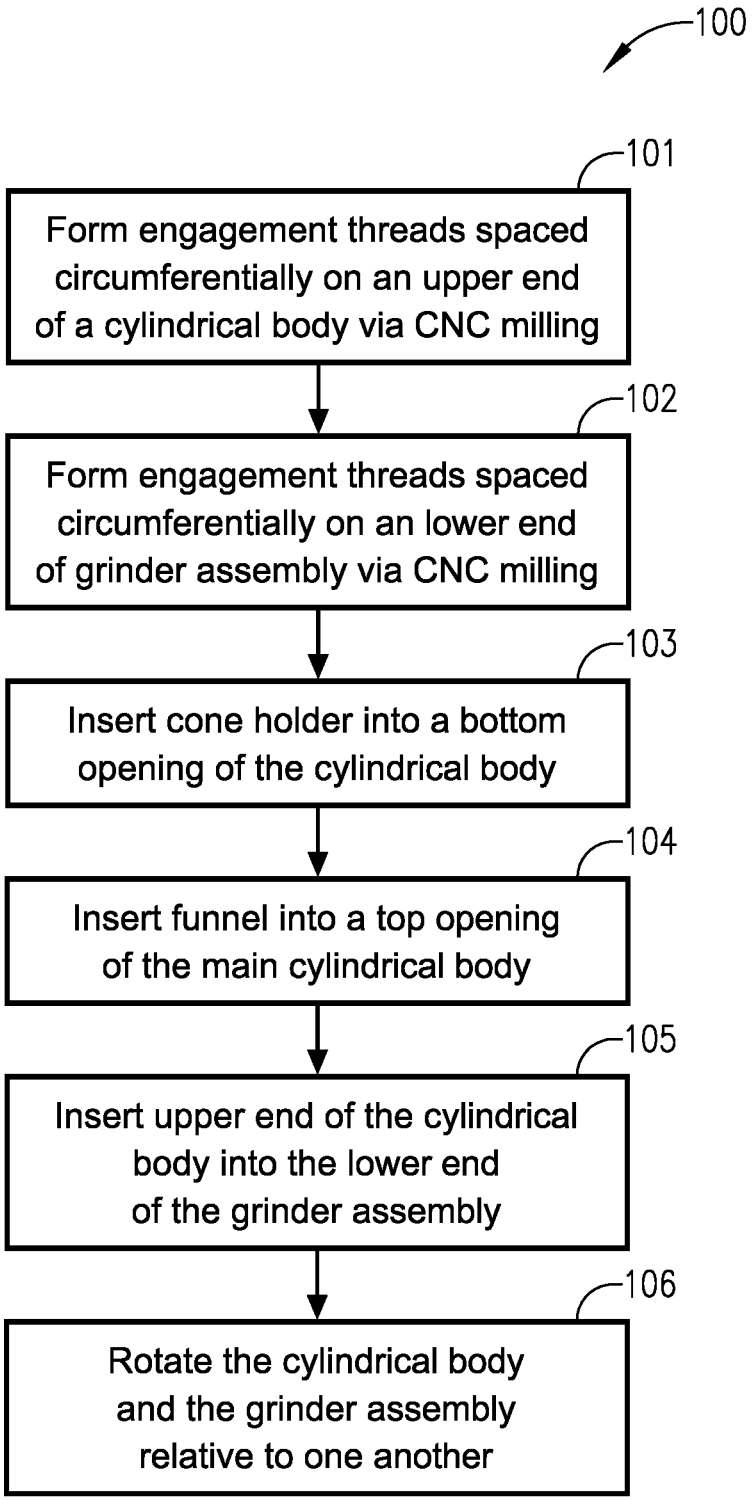
FIG. 9 is a flowchart depicting exemplary steps of a method according to an embodiment of the present invention.

The flow chart of FIG. 9 depicts the steps of an exemplary method 100 of forming an apparatus for preparing organic material and loading the organic material into a cone. In some alternative implementations, the functions noted in the various blocks may occur out of the order depicted in FIG. 9. For example, two blocks shown in succession in FIG. 9 may in fact be executed substantially concurrently, or the blocks may sometimes be executed in the reverse order depending upon the functionality involved. In addition, some steps may be optional.

Referring to step 101, engagement threads are formed spaced circumferentially on an upper end of a main cylindrical body via CNC milling. The engagement threads may be formed on an outer surface of the cylindrical body. The engagement threads may comprise a number of sets of engagement threads evenly spaced circumferentially on the upper end. In some embodiments, three sets of engagement threads are formed. Each set of engagement threads may comprise three threads protruding from the upper end of the cylindrical body and circumferentially extend in parallel on the upper end of the cylindrical body. In some embodiments, the cylindrical body and therefore the engagement threads may be made of aluminum, aluminum alloy, or the like. By forming via CNC milling, the dimensions of the engagement threads are consistent and uniform, thereby preventing jams when attaching and removing components. This step may also include forming engagement threads circumferentially spaced on a lower end of the cylindrical body via CNC milling. In some embodiments, the cylindrical body itself is formed via CNC milling.

Referring to step 102, engagement threads are formed circumferentially spaced on a lower end of a grinder assembly via CNC milling. The engagement threads may be formed on an inner surface of the lower end. The engagement threads may also comprise a number of sets of engagement threads evenly spaced circumferentially on a lower end of a grinder cylindrical body that is operable to mate with the upper end of the cylindrical body. The engagement threads are complementary to and operable to engage the engagement threads on the upper end of the cylindrical body. In some embodiments, three sets of engagement threads are formed. Each set of engagement threads may comprise three threads protruding from the lower end of the grinder cylindrical body and circumferentially extending in parallel on the lower end of the grinder cylindrical body. In some embodiments, the grinder cylindrical body and therefore the engagement threads formed thereon may be made of aluminum, aluminum alloy, or the like. Portions of the grinder assembly may be formed via CNC milling. By forming via CNC milling, the dimensions of the engagement threads are consistent and uniform, thereby preventing jams when attaching and removing the grinder assembly from the main cylindrical body. In some embodiments, the blades of the grinder assembly are made of FDA grade titanium, titanium alloy, or the like.

Referring to step 103, a cone holder is inserted into a bottom opening of the cylindrical body. This step may include forming engagement threads circumferentially spaced on a lower end of the cone holder via CNC milling. The cone holder may also be made of aluminum, aluminum alloy, or the like and formed via CNC milling. By forming via CNC milling, the dimensions of the engagement threads are consistent and uniform, thereby preventing jams when attaching and removing the cone holder from the main cylindrical body. This step may also include orienting the threads of the cylindrical body so that they pass through spaces defined by the circumferentially spaced threads of the cone holder. Once the cone holder is inserted into the cylindrical body, this step may include rotating the cone holder and the cylindrical body relative to one another so that the engagement threads of the cylindrical body engage the engagement threads of the cone holder, thereby releasably securing the cone holder to the cylindrical body.

Referring to step 104, a funnel is inserted into a top opening of the main cylindrical body so that a narrow portion of the funnel extends into an end opening of a cone when the cone is held by the cone holder within the cylindrical body. The funnel may be inserted into the top opening of the cylindrical body so that a portion of the funnel abuts the upper end of the cylindrical body. Particularly, the funnel may include a flange that abuts the upper end of the cylindrical body. The funnel may also be made of aluminum, aluminum alloy, or the like and formed via CNC milling. The funnel and cylindrical body may be tightly mated so that the funnel is semi-permanently secured to the cylindrical body, e.g., it would require significant force and/or lubricants to push the funnel out of the cylindrical body.

Referring to step 105, the upper end of the cylindrical body is inserted into the lower end of the grinder assembly. This step may include inserting the cylindrical body into the bottom opening of the lower end of the grinder cylindrical body until a collar of the cylindrical body abuts the lower end of the grinder assembly. This step may also include orienting the threads of the cylindrical body so that they pass through spaces defined by the circumferentially spaced threads of the grinder assembly. This step may include inserting the cylindrical body into the lower end of the grinder assembly with the funnel already inserted into the cylindrical body so that the funnel is sandwiched by the grinder assembly and the cylindrical body. In some embodiments, a lower blade of the grinder assembly abuts the flange of the funnel.

Referring to step 106, the cylindrical body is rotated relative to the grinder assembly so that the engagement threads of the grinder assembly engage engagement threads of the cylindrical body, thereby releasably securing the grinder assembly to the cylindrical body.

The method 100 may include additional, less, or alternate steps and/or device(s), including those discussed elsewhere herein.

Additional Considerations

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, it should be understood that the legal scope of the description is defined by the words of the claims set forth in any subsequent regular utility patent application. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim (s).

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. An apparatus for preparing organic material and loading the organic material into a cone with an end opening, the apparatus comprising:

a cylindrical body with a top opening and a bottom opening;

a grinder assembly removably attached to the top opening of the cylindrical body and configured to grind the organic material, the grinder assembly including one or more hole for the ground organic material to pass through;

a cone holder extending into the bottom opening of the cylindrical body and releasably secured thereto, the cone holder including an aperture for receiving the cone; and a funnel comprising a wide portion for receiving the ground organic material that passes through the one or more hole of the grinder assembly and a narrow portion that extends into the end opening of the cone when the cone is held by the cone holder in the cylindrical body.

2. The apparatus of claim 1, wherein the funnel is seated on the cylindrical body.

3. The apparatus of claim 2, wherein the funnel is sandwiched between the grinder assembly and the cylindrical body.

4. The apparatus of claim 1, further comprising a packer rod configured to be inserted through the funnel when the grinder assembly is removed.

5. The apparatus of claim 1, wherein the cone holder comprises a top end and a bottom end, and the aperture extends from the top end to the bottom end and is funnel-shaped with a wide region proximal to the top end and a narrow region distal to the top end.

6. The apparatus of claim 1, wherein— the cylindrical body comprises an upper end defining the top opening, and a first plurality of engagement threads circumferentially spaced on the upper end, and the grinder assembly comprises a lower end defining a bottom opening for receiving the upper end of the cylindrical body, and a second plurality of engagement threads circumferentially spaced on the lower end for releasably engaging the first plurality of engagement threads.

7. The apparatus of claim 6, wherein the first plurality of engagement threads comprises two or more sets of engagement threads evenly spaced circumferentially on the upper end.

8. The apparatus of claim 7, wherein each of the two or more sets of engagement threads comprises three threads protruding from the upper end of the cylindrical body and circumferentially extending in parallel on the upper end of the cylindrical body.

9. The apparatus of claim 1, wherein the cylindrical body, the cone holder, and the funnel are made of aluminum, and the grinder assembly comprises a pair of blades made of titanium and configured to grind the organic material.

10. The apparatus of claim 1, wherein— the cylindrical body comprises a lower end and a third plurality of engagement threads circumferentially spaced on the lower end, and the cone holder comprises a fourth plurality of engagement threads configured to engage the third plurality of engagement threads.

11. An apparatus for preparing organic material and loading the organic material into a cone with an end opening, the apparatus comprising:

a main cylindrical body with a bottom opening, an upper end defining a top opening, and a first plurality of engagement threads circumferentially spaced on the upper end;

a grinder assembly removably attached to the top opening of the main cylindrical body and configured to grind the organic material, the grinder assembly comprising— a grinder cylindrical body with a top opening, a lower end defining a bottom opening for receiving the upper end of the main cylindrical body, and a second plurality of engagement threads circumferentially spaced on the lower end for releasably engaging the first plurality of engagement threads, an upper body that releasably mates with the grinder cylindrical body, a top blade secured to the upper body, and a bottom blade secured to the grinder cylindrical body and including a hole for allowing the ground organic material to pass therethrough;

a cone holder extending into the bottom opening of the main cylindrical body and releasably secured thereto, the cone holder including an aperture for receiving the cone; and a funnel that extends into the top opening of the main cylindrical body and comprising— a flange that sits on the upper end of the main cylindrical body so that the flange is secured between the grinder assembly and the main cylindrical body, a wide portion that opens to the bottom blade of the grinder assembly for receiving the ground organic material therefrom, and a narrow portion that extends into the end opening of the cone when the cone is held by the cone holder.

12. The apparatus of claim 11, wherein the cone holder comprises a top end and a bottom end, and the aperture extends from the top end to the bottom end and is funnel-shaped with a wide region proximal to the top end and a narrow region distal to the top end.

13. The apparatus of claim 12, further comprising a packer rod configured to be inserted into the aperture from the bottom end.

14. The apparatus of claim 13, wherein the aperture has a diameter at the bottom end that is smaller than a diameter of the cone.

15. The apparatus of claim 11, wherein the bottom blade abuts the flange of the funnel when the grinder assembly is secured to the main cylindrical body.

16. The apparatus of claim 11, wherein— the main cylindrical body comprises a lower end and a third plurality of engagement threads circumferentially spaced on the lower end, and the cone holder comprises a fourth plurality of engagement threads configured to engage the third plurality of engagement threads.

* * * * *